US008789375B2

(12) United States Patent
Haynes

(10) Patent No.: US 8,789,375 B2
(45) Date of Patent: Jul. 29, 2014

(54) GAS TURBINE COMBUSTOR HAVING COUNTERFLOW INJECTION MECHANISM AND METHOD OF USE

(71) Applicant: General Electric Company, Schenectady, NY (US)

(72) Inventor: Joel Meier Haynes, Schenectady, NY (US)

(73) Assignee: General Electric Company, Niskayuna, NY (US)

( * ) Notice: Subject to any disclaimer, the term of this patent is extended or adjusted under 35 U.S.C. 154(b) by 0 days.

(21) Appl. No.: 13/653,258

(22) Filed: Oct. 16, 2012

(65) Prior Publication Data

US 2013/0036745 A1 Feb. 14, 2013

Related U.S. Application Data

(62) Division of application No. 11/325,642, filed on Jan. 3, 2006, now Pat. No. 8,387,390.

(51) Int. Cl.
*F02C 1/00* (2006.01)

(52) U.S. Cl.
USPC ..... 60/772; 60/740; 60/758

(58) Field of Classification Search
USPC ..... 60/39.45, 39.37, 740, 742, 746, 747, 60/752, 758, 772, 776
See application file for complete search history.

(56) References Cited

U.S. PATENT DOCUMENTS 2,617,252 A * 11/1952 Klein ..... 60/761
3,531,937 A 10/1970 Sneeden
4,168,609 A * 9/1979 Greenberg et al. ..... 60/804
4,549,402 A 10/1985 Saintsbury et al.
4,805,411 A 2/1989 Hellat et al.
4,813,227 A 3/1989 Rice
4,866,884 A 9/1989 Smith et al.
4,877,396 A 10/1989 Wunning (Continued)

FOREIGN PATENT DOCUMENTS

EP 1355111 A2 10/2003
EP 1431543 A2 6/2004

(Continued)

OTHER PUBLICATIONS

Dr. -Ing. K. Kusterer; Article entitled FLOXCOMM—WP7, Modeling and Optimisation of Wall Cooling—Wall Temperature and Stress Analysis, B&B AGEMA, Meeting, Bari, Nov. 21, 2003, 17 pages.

(Continued)

*Primary Examiner* — Phutthiwat Wongwian
(74) *Attorney, Agent, or Firm* — Ann M. Agosti

(57) ABSTRACT

A method of using a counterflow injection mechanism disposed in a combustion liner. The combustion liner including an outer casing comprising a plurality of openings formed along a length and configured as compressed air inlets, an inner casing having a closed rear end and a combustion outlet, and an air circulation path extending between and along the inner and outer casings. The counterflow injection mechanism includes a fuel-air injection mechanism having fuel and air passages extending through the air circulation path and leading to fuel and air injection openings disposed at an off-center position. The method includes injecting fuel and air from the injection mechanism toward the closed rear end of the inner casing in a direction counterflow to a generally lengthwise downstream flow of combustion products in a gas turbine combustor.

20 Claims, 13 Drawing Sheets

(56) References Cited

U.S. PATENT DOCUMENTS

| | | | | |
|---|---|---|---|---|
| 4,922,840 | A | 5/1990 | Woodroffe et al. | |
| 5,070,700 | A | 12/1991 | Mowill | |
| 5,154,599 | A | 10/1992 | Wunning | |
| 5,259,184 | A | 11/1993 | Borkowicz et al. | |
| 5,274,991 | A | 1/1994 | Fitts | |
| 5,277,021 | A | 1/1994 | Shekleton | |
| 5,277,022 | A | 1/1994 | Shekleton et al. | |
| 5,295,354 | A * | 3/1994 | Barbier et al. | 60/731 |
| 5,304,434 | A | 4/1994 | Stone | |
| 5,487,659 | A | 1/1996 | Eroglu et al. | |
| 5,570,679 | A | 11/1996 | Wunning | |
| 5,577,386 | A | 11/1996 | Alary et al. | |
| 5,579,645 | A * | 12/1996 | Prociw et al. | 60/740 |
| 5,628,182 | A | 5/1997 | Mowill | |
| 6,047,550 | A | 4/2000 | Beebe | |
| 6,095,791 | A | 8/2000 | Senior | |
| 6,148,604 | A | 11/2000 | Salt et al. | |
| 6,315,552 | B1 | 11/2001 | Haynes et al. | |
| 6,325,618 | B1 | 12/2001 | Benz et al. | |
| 6,371,754 | B1 | 4/2002 | Haynes | |
| 6,439,881 | B2 | 8/2002 | Haynes et al. | |
| 6,439,882 | B2 | 8/2002 | Haynes et al. | |
| 6,619,026 | B2 | 9/2003 | Carelli et al. | |
| 6,735,949 | B1 | 5/2004 | Haynes et al. | |
| 6,868,676 | B1 | 3/2005 | Haynes | |
| 6,935,328 | B2 | 8/2005 | Haynes et al. | |
| 6,951,108 | B2 | 10/2005 | Burrus et al. | |
| 7,568,343 | B2 * | 8/2009 | Harris et al. | 60/732 |
| 2005/0058959 | A1 | 3/2005 | Fortin et al. | |
| 2007/0022758 | A1 * | 2/2007 | Myers et al. | 60/776 |
| 2007/0033945 | A1 | 2/2007 | Goldmeer et al. | |
| 2007/0119179 | A1 | 5/2007 | Haynes | |
| 2007/0151251 | A1 | 7/2007 | Haynes | |

FOREIGN PATENT DOCUMENTS

| | | | |
|---|---|---|---|
| JP | 5013808 | U | 2/1975 |
| JP | S63156926 | A | 6/1988 |
| JP | 06265146 | A | 9/1994 |
| JP | 0777316 | A | 3/1995 |
| JP | 09222205 | A | 8/1997 |
| JP | 1163500 | A | 3/1999 |
| JP | 2000234735 | A | 8/2000 |
| JP | 2004170010 | A | 6/2004 |
| JP | 2006010193 | A | 1/2006 |
| WO | WO03/091626 | A1 | 11/2003 |
| WO | 2006085922 | A2 | 8/2006 |

OTHER PUBLICATIONS

Yeshayahou Levy, Article entitled "Chemical Aspects of the Flameless Oxidation Applied for Gas Turbine Combustor", 2 pages.

Dr. N.H. Kkandamby; Article entitled "Low Nox Combustor for High Efficiency Gas Turbines", FLOXCOM Final Meeting, Nov. 21, 2003, 30 pages.

Joachim G. Wunning, Article entitled "Flameless Combustion and Its Applications", Noordwijkerhout, May 2004, 42 pages.

FLOXCOM Project WP5 36 Month Report, Polish Academy of Sciences, Institute of Fundamental Technological Research, Warsaw, Poland.

Iyiola Awosope, Article Entitled "Low Nox Flameless Oxidation Combustor for High Efficiency Gas Turbines", Imperial College, London, Nov. 19, 2003, 66 pages.

M.J. Melo, et al., Article Entitled "FLOXCOM Low Nox Flox Combustor for High Efficienty Gas Turbines", Instituto Superior Tecnico/Technical University of Lisbon, Lisboa, Protugal, 51 pages.

A. Milani and A. Sapoparo, Article Entitled "Diluted Combustion Technologies", IFRF Combustion Journal, Article No. 200101, Feb. 2001, 33 pages.

Unofficial English translation of Office Action issued in connection with corresponding KR Application No. 2007-0009695 on Oct. 28, 2013.

Unofficial English Translation of JP Notice of Allowance dated Nov. 29, 2013, issued in connection with corresponding JP Application No. 2007-018737.

* cited by examiner

GAS TURBINE COMBUSTOR HAVING COUNTERFLOW INJECTION MECHANISM AND METHOD OF USE

BACKGROUND

This section is intended to introduce the reader to various aspects of art that may be related to aspects of the present invention, which are described and/or claimed below. This discussion is believed to be helpful in providing the reader with background information to facilitate a better understanding of the various aspects of the present invention. Accordingly, it should be understood that these statements are to be read in this light, and not as admissions of prior art.

Combustion engines, such as gas turbine engines, produce a variety of pollutant emissions. For example, pollutant emissions generally include carbon oxides (COx), nitrogen oxides (NOx), sulfur oxides (SOx), and particulate matter (PM). These pollutant emissions are highly regulated in the United States and elsewhere. NOx emissions from a gas turbine engine can be reduced by premixing fuel and air. Unfortunately, premixing can result in unstable flames that are difficult to anchor, and the best premixed systems today cannot reach the NOx emission targets. Another approach is selective catalytic reduction (SCR) of NOx through ammonia injection. Unfortunately, the SCR approach is relatively expensive.

Accordingly, an improved technique is needed to reduce pollutant emissions, such as NOx emissions, from a gas turbine combustor.

BRIEF DESCRIPTION

Certain aspects commensurate in scope with the originally claimed invention are set forth below. It should be understood that these aspects are presented merely to provide the reader with a brief summary of certain forms the invention might take and that these aspects are not intended to limit the scope of the invention. Indeed, the invention may encompass a variety of aspects that may not be set forth below.

In accordance with certain embodiments, a system includes a counterflow injection mechanism. The counterflow injection mechanism includes a fuel-air injection mechanism having fuel and air passages leading to fuel and air injection openings, wherein the fuel and air injection openings are disposed at an off-center position and a generally counterflow direction relative to a generally lengthwise flow axis of a gas turbine combustor.

In accordance with other embodiments, a system includes a gas turbine combustor having a combustion liner. The combustion liner includes an outer casing having a compressed air inlet, an inner casing having a combustion outlet, an air circulation path extending between and along the inner and outer casings, and a generally lengthwise flow axis extending from a stagnation zone to the combustion outlet. The gas turbine combustor also includes a counterflow injection mechanism disposed in the combustion liner downstream from the stagnation zone in a generally off-center counterflow configuration relative to the generally lengthwise flow axis. The counterflow injection mechanism includes one or more fuel passages extending through the combustion liner to a plurality of fuel injection openings, and one or more air passages extending through the inner casing from the air circulation path to a plurality of air injection openings.

In accordance with further embodiments, a method includes injecting fuel and air at an off-center position and a generally counterflow direction relative to a generally lengthwise flow axis of a gas turbine combustor.

Various refinements of the features noted above exist in relation to the various aspects of the present invention. Further features may also be incorporated in these various aspects as well. These refinements and additional features may exist individually or in any combination. For instance, various features discussed below in relation to one or more of the illustrated embodiments may be incorporated into any of the above-described aspects of the present invention alone or in any combination. Again, the brief summary presented above is intended only to familiarize the reader with certain aspects and contexts of the present invention without limitation to the claimed subject matter.

DRAWINGS

These and other features, aspects, and advantages of the present invention will become better understood when the following detailed description is read with reference to the accompanying drawings in which like characters represent like parts throughout the drawings, wherein.

Figure 1:
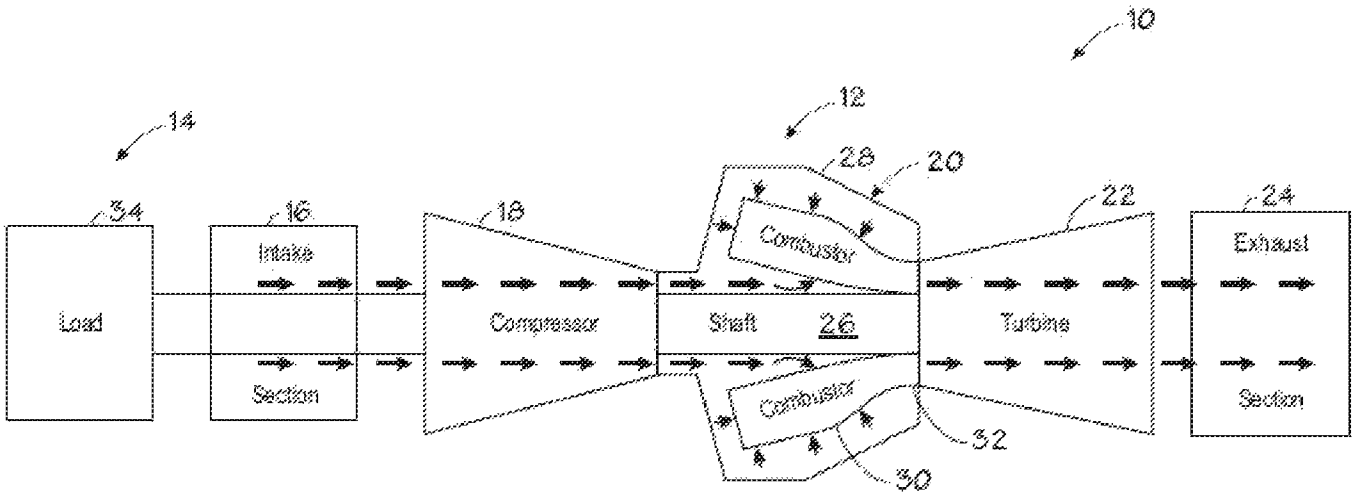
FIG. 1 is a block diagram of an exemplary system having a gas turbine engine coupled to a load in accordance with certain embodiments of the present technique.
Figure 2:
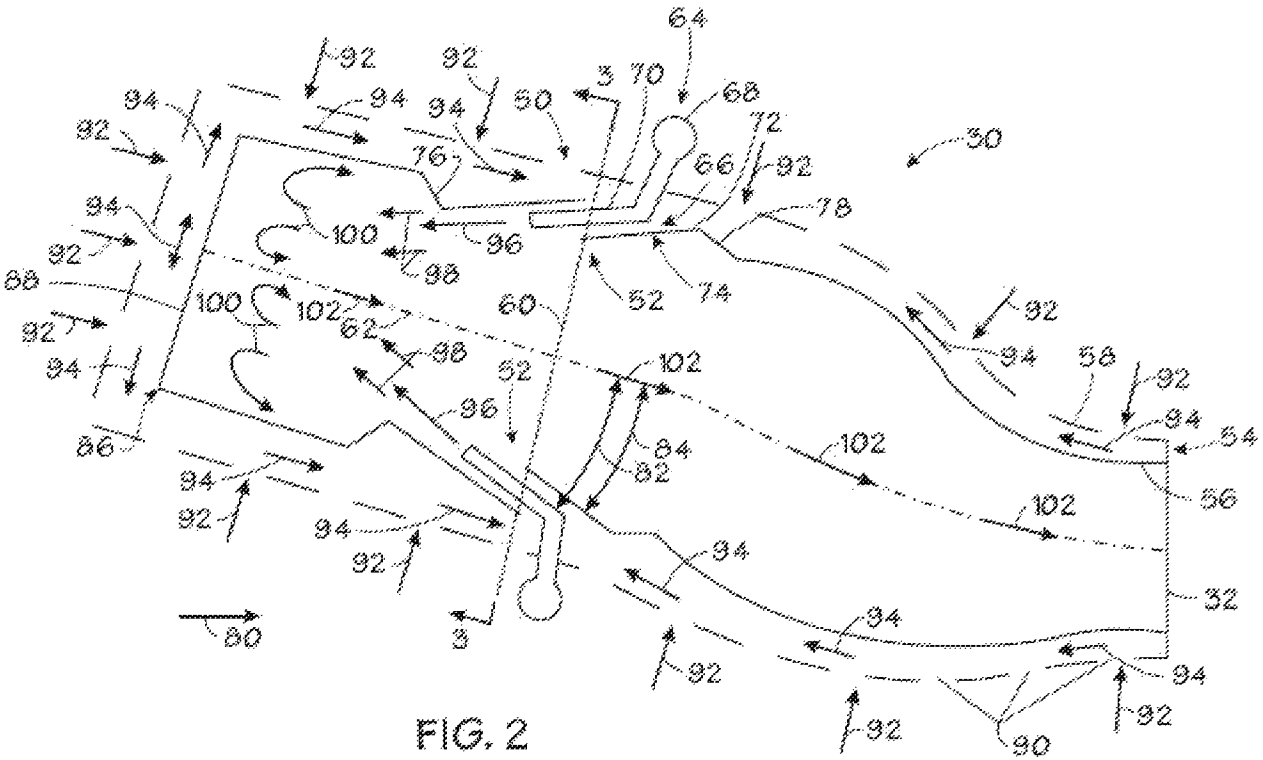
FIG. 2 is a lengthwise diagrammatical view of an exemplary combustor of the gas turbine engine as illustrated in FIG. 1, further illustrating a counterflow injection mechanism having a plurality of fuel-air injection lobes arranged circumferentially along a solid inner casing of the combustor in accordance with certain embodiments of the present technique.
Figure 5:
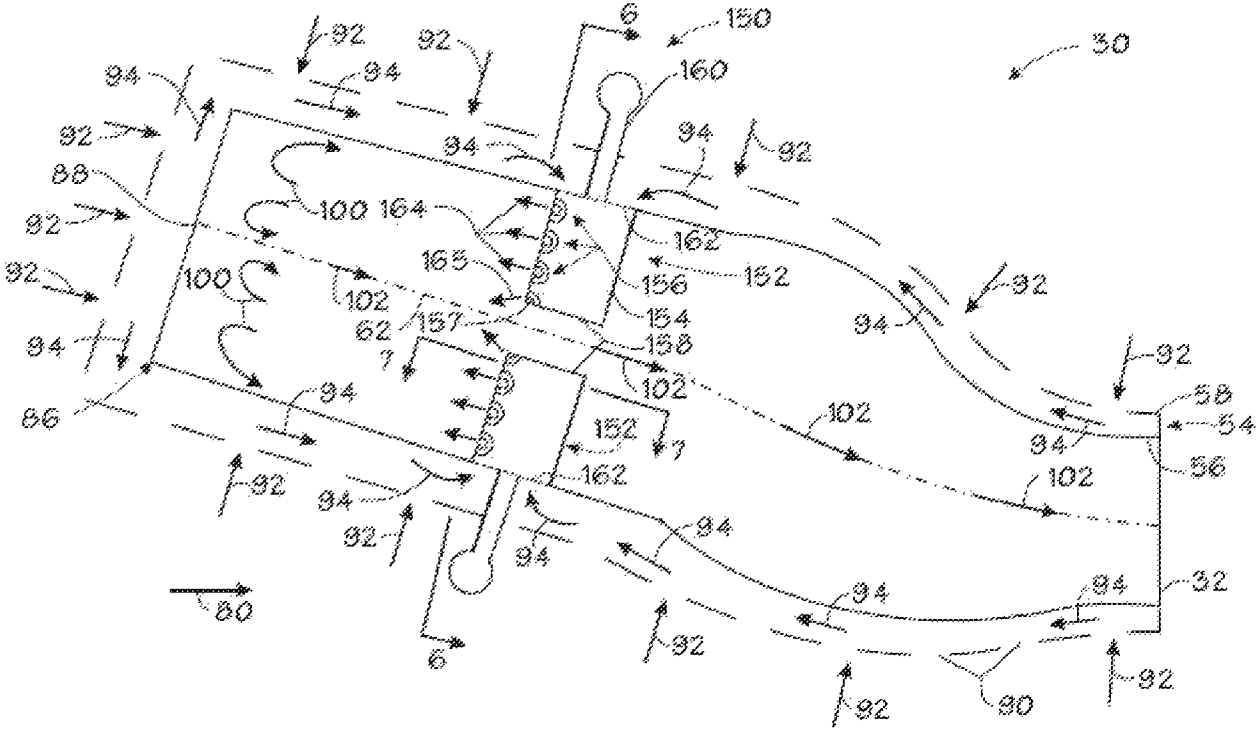
Figure 6:
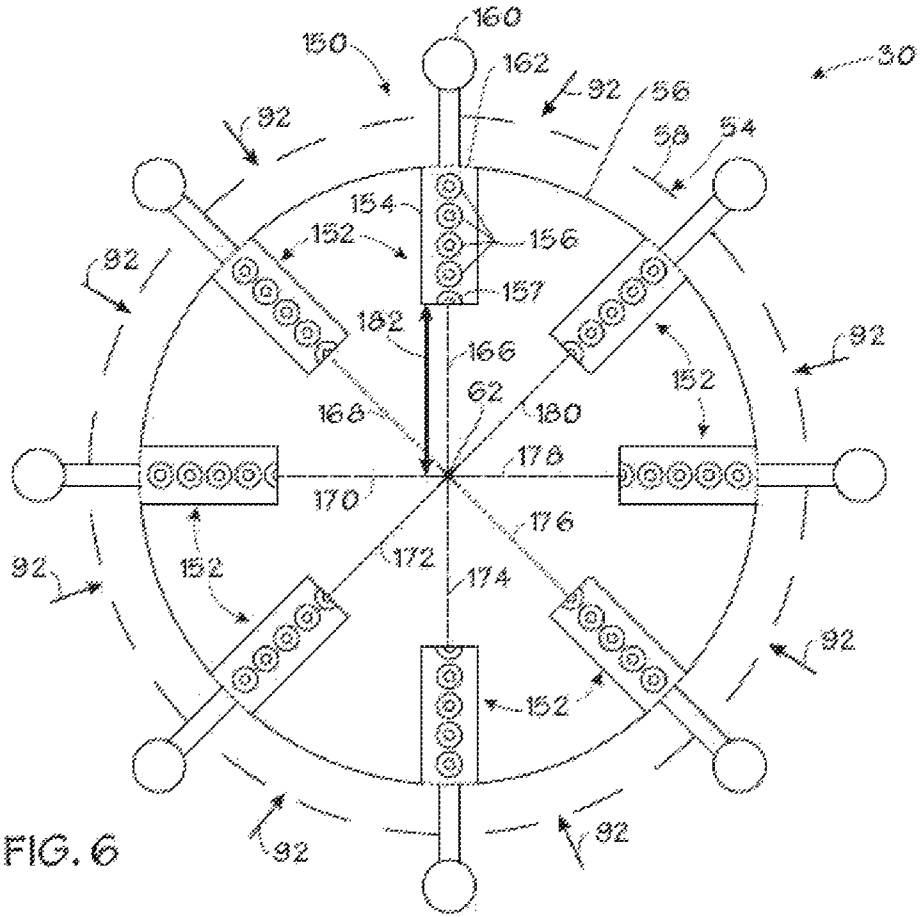
Figure 7:
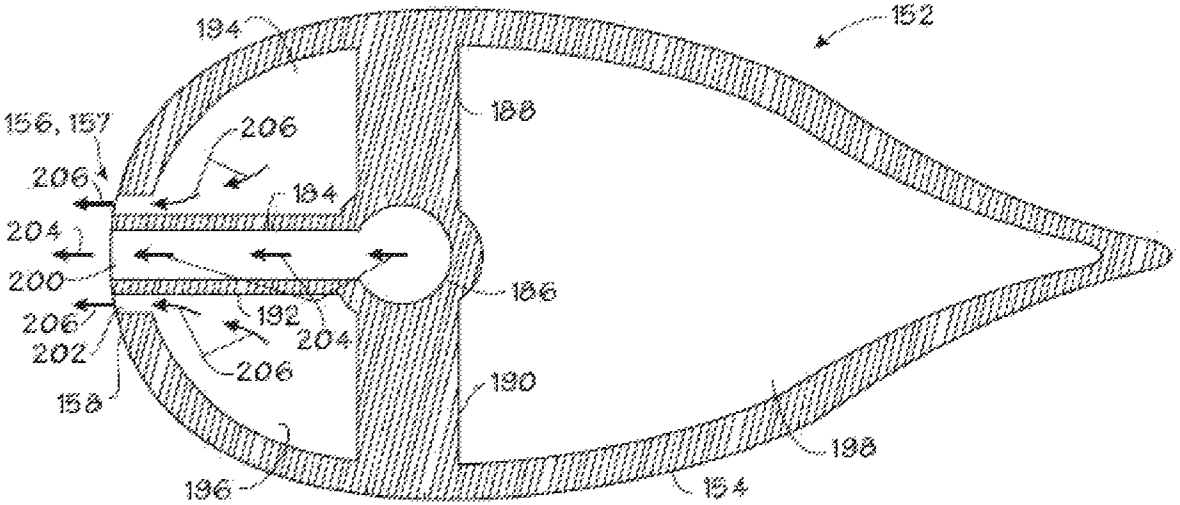
Figure 8:
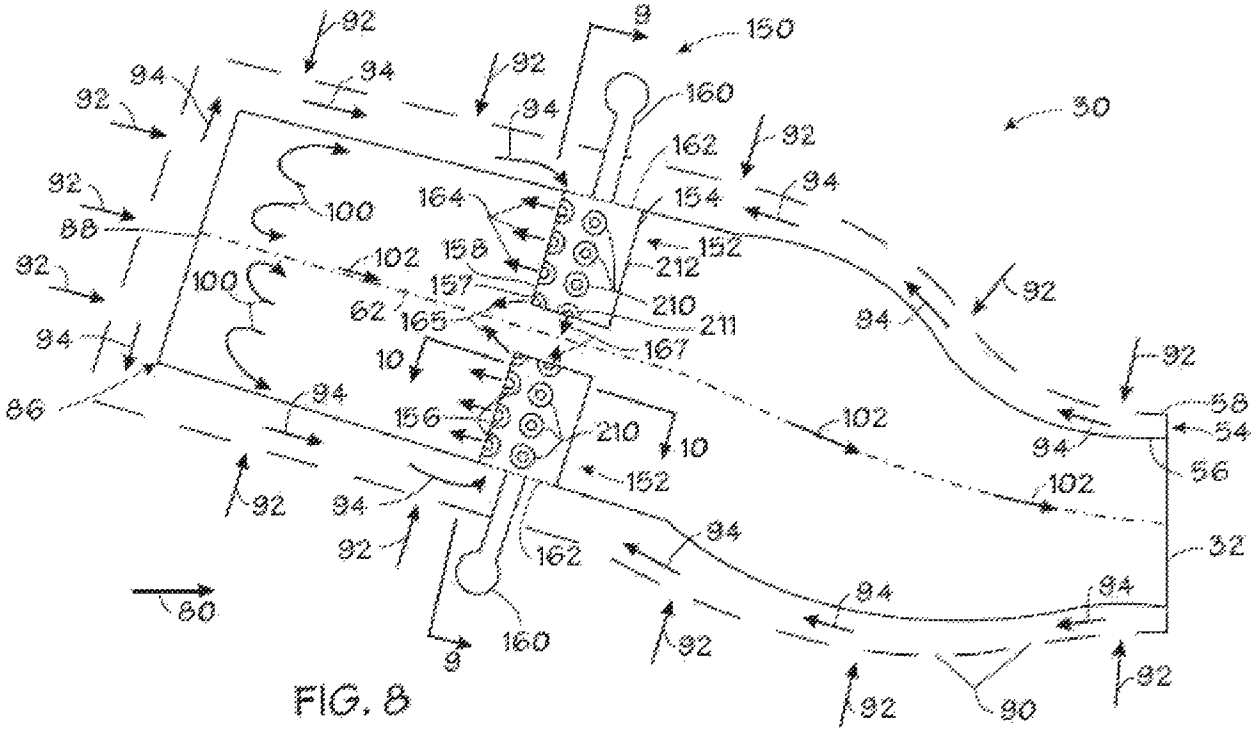
Figure 9:
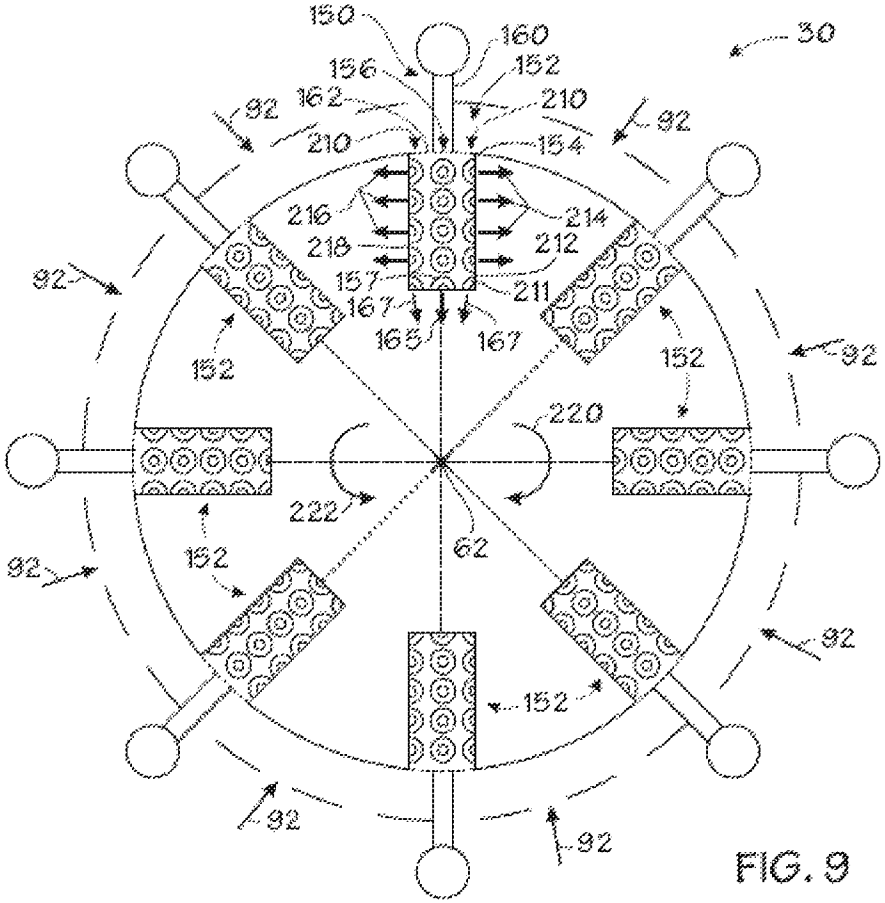
Figure 10:
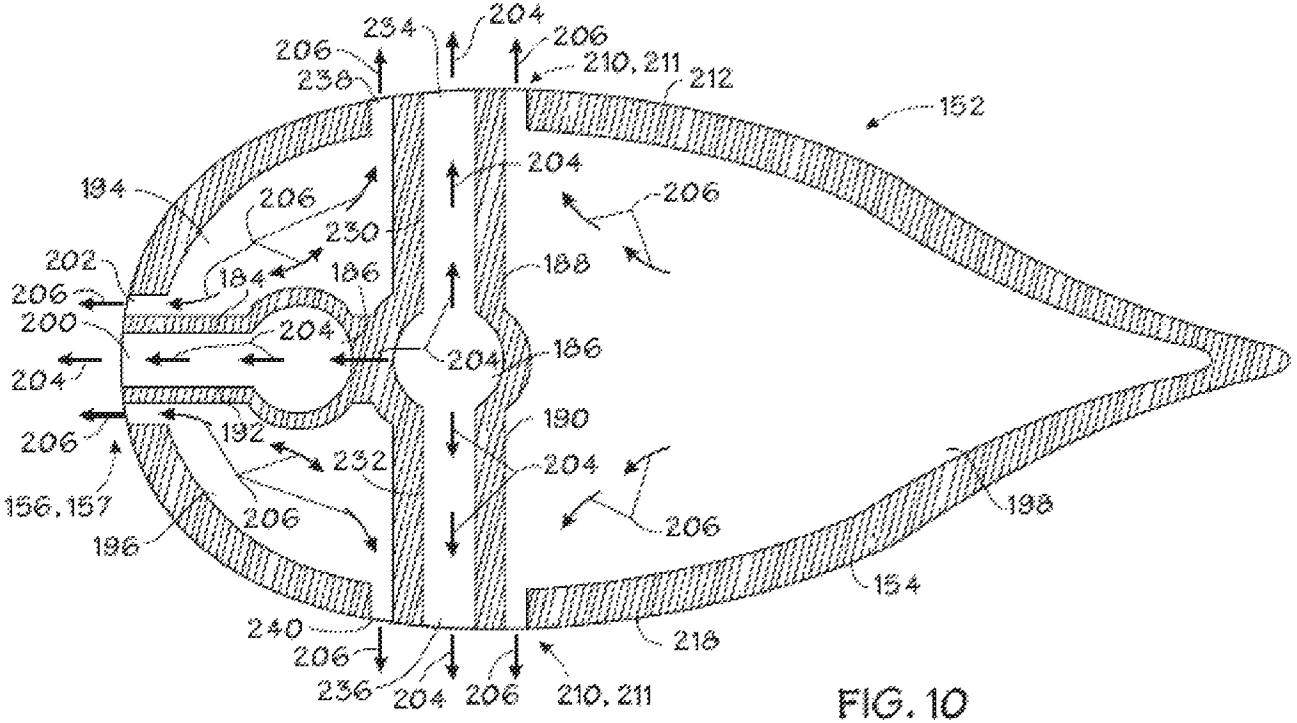
Figure 11:
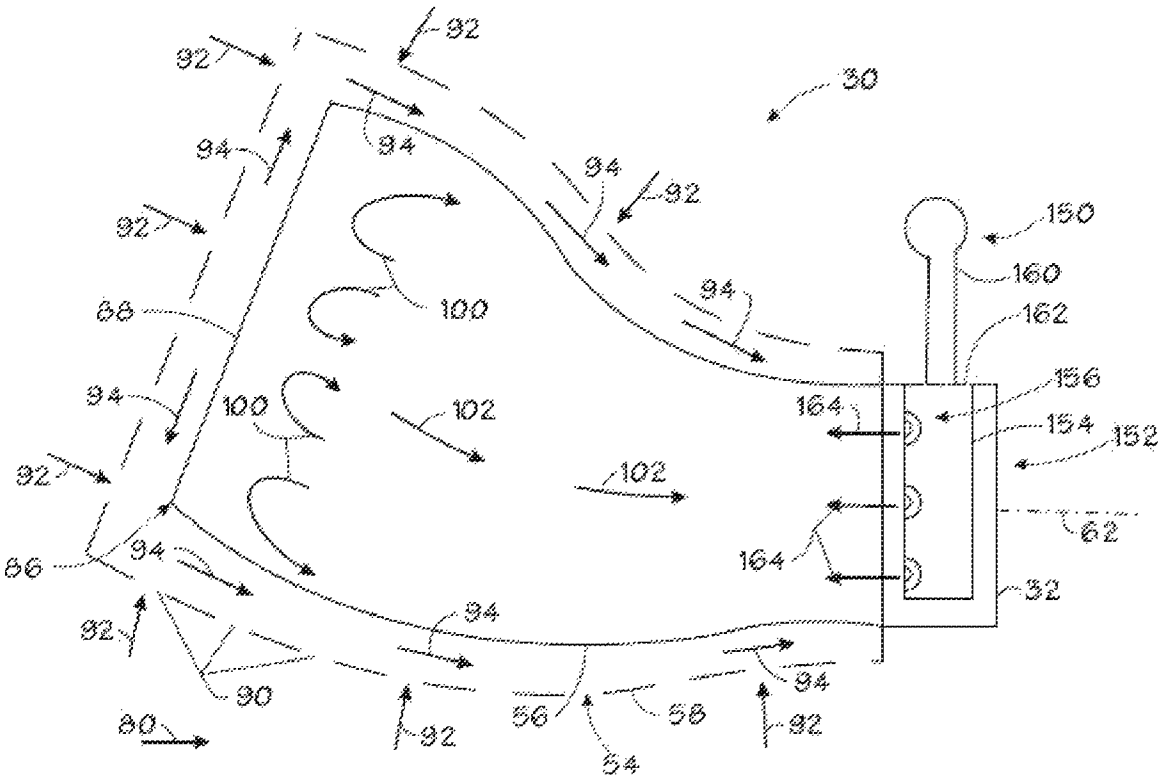
Figure 12:
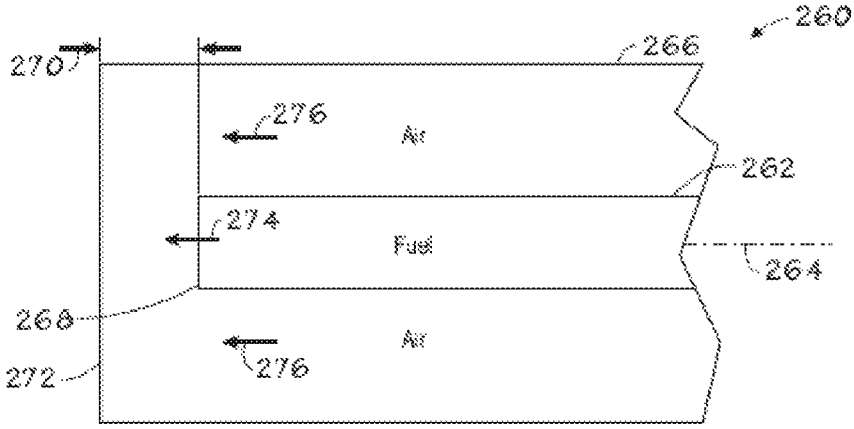
Figure 13:
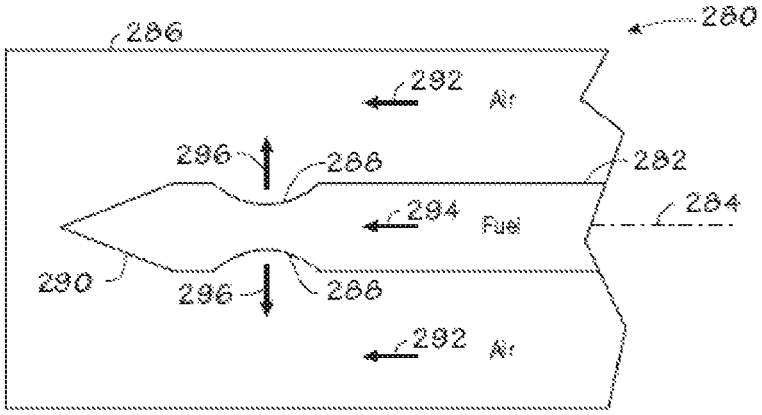
Figure 14:
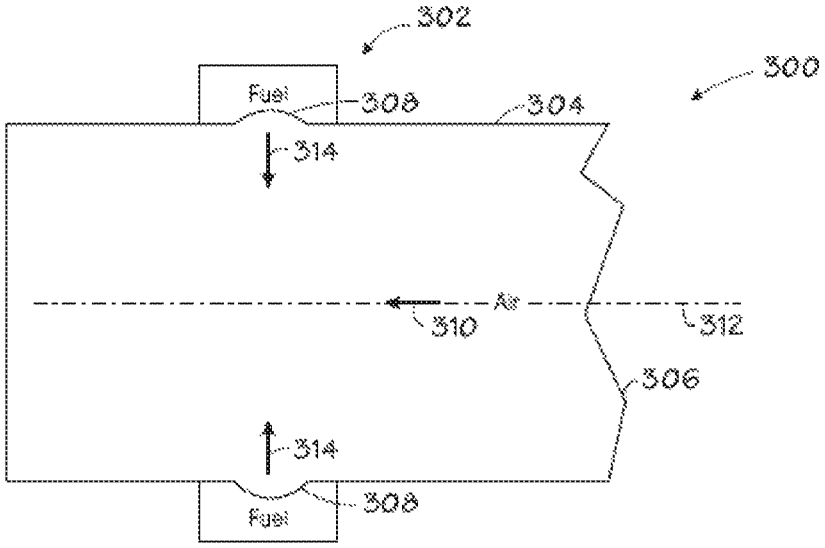
Figure 15:
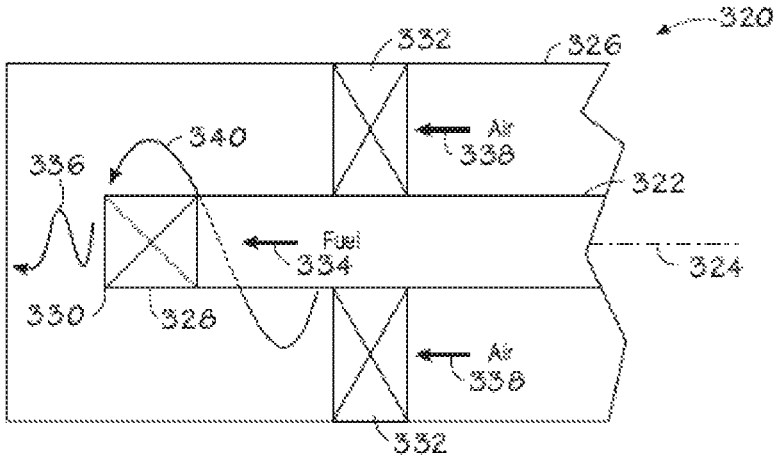

FIG. 5 is a lengthwise diagrammatical view of an alternative embodiment of the combustor as illustrated in FIGS. 1 and 2, further illustrating a counterflow injection mechanism having a radial array of inwardly cantilevered fuel-air injection members arranged circumferentially along a solid inner casing of the combustor, wherein each of the inwardly cantilevered fuel-air injection members has a plurality of coaxial fuel-air ports oriented generally lengthwise and counterflow relative to a lengthwise flow axis of the combustor;

FIG. 6 is a crosswise diagrammatical view of an embodiment of the combustor as illustrated in FIG. 5, further illustrating the radial array of inwardly cantilevered fuel-air injection members disposed at multiple radial positions along the circumference of the solid inner casing;

FIG. 7 is a cross-sectional view of an embodiment of one of the inwardly cantilevered fuel-air injection members as illustrated in FIG. 5, further illustrating coaxial flow of fuel and air in a direction generally lengthwise and counterflow relative to a lengthwise flow axis of the combustor;

FIG. 8 is a lengthwise diagrammatical view of an alternative embodiment of the combustor as illustrated in FIG. 5, wherein each of the inwardly cantilevered fuel-air injection members further includes a plurality of coaxial fuel-air port oriented generally crosswise and counterflow relative to the lengthwise flow axis of the combustor;

FIG. 9 is a crosswise diagrammatical view of an embodiment of the combustor as illustrated in FIG. 8, further illustrating the radial array of inwardly cantilevered fuel-air injection members disposed at multiple radial positions along the circumference of the solid inner casing;

FIG. 10 is a cross-sectional view of an embodiment of one of the inwardly cantilevered fuel-air injection members as illustrated in FIG. 8, further illustrating coaxial flow of fuel and air in a direction generally lengthwise and counterflow relative to a lengthwise flow axis of the combustor and, also, illustrating coaxial flow of fuel and air in two opposite directions generally crosswise and counterflow relative to the lengthwise flow axis of the combustor;

FIG. 11 is a lengthwise diagrammatical view of another embodiment of the combustor as illustrated in FIG. 1, further illustrating a counterflow injection mechanism having a single inwardly cantilevered fuel-air injection member disposed on a solid inner casing of the combustor at or near a turbine nozzle, wherein the inwardly cantilevered fuel-air injection member has a plurality of coaxial fuel-air ports oriented generally lengthwise and counterflow relative to a lengthwise flow axis of the combustor;

FIG. 12 is a diagram of an exemplary fuel-air injector having coaxial fuel and air flows in the same lengthwise or axial direction in accordance with certain embodiments of the present technique;

FIG. 13 is a diagram of an alternative embodiment of a fuel-air injector having coaxial fuel and air flows, wherein the fuel flow is redirected in a crosswise or outward radial direction relative to the air flow;

FIG. 14 is a diagram of another alternative embodiment of a fuel-air injector having a central axial air flow and outer fuel flows directed in a crosswise or inwardly radial direction relative to the air flow; and FIG. 15 is a diagram of a further alternative embodiment of a fuel-air injector having coaxial fuel and air flows including swirl mechanisms for both the fuel and air flows.

DETAILED DESCRIPTION

One or more specific embodiments of the present invention will be described below. In an effort to provide a concise description of these embodiments, all features of an actual implementation may not be described in the specification. It should be appreciated that in the development of any such actual implementation, as in any engineering or design project, numerous implementation-specific decisions must be made to achieve the developers' specific goals, such as compliant with system-related and business-related constraints, which may vary from one implementation to another. Moreover, it should be appreciated that such a development effort might be complex and time consuming, but would nevertheless be a routine undertaking of design, fabrication, and manufacture for those of ordinary skill having the benefit of this disclosure.

FIG. 1 is a block diagram of an exemplary system 10 including a gas turbine engine 12 coupled to an application 14 in accordance with certain embodiments of the present technique. In certain embodiments, the system 10 may include an aircraft, a watercraft, a locomotive, a power generation system, or combinations thereof. Accordingly, the application 14 may include a generator, a propeller, or combinations thereof. The illustrated gas turbine engine 12 includes an air intake section 16, a compressor 18, a combustor section 20, a turbine 22, and an exhaust section 24. The turbine 22 is drivingly coupled to the compressor 18 via a shaft 26. As discussed in further detail below, the disclosed embodiments of the combustor section 20 include a variety of counterflow fuel-air injection mechanisms, which facilitate mixing of fuel, air, and hot products of combustion within the combustion section. More specifically, the disclosed counterflow fuel-air injection mechanisms inject both fuel and air one or more directions generally against or counter to the general flow through the gas turbine engine 12 and, particularly, the combustor section 20.

As indicated by the arrows, air flows through the intake section 16 and into the compressor 18, which compresses the air prior to entry into the combustor section 20. The illustrated combustor section 20 includes a combustor housing 28 disposed concentrically or annularly about the shaft 26 between the compressor 18 and the turbine 22. Inside the combustor housing 28, the combustor section 20 includes a plurality of combustors 30 disposed at multiple radial positions in a circular or annular configuration about the shaft 26. As discussed in further detail below, the compressed air from the compressor 18 enters each of the combustors 30, and then mixes and combusts with fuel within the respective combustors 30 to drive the turbine 22.

In certain embodiments, the combustors 30 may be configured as multi-stage combustors, wherein fuel injectors are positioned at different stages along the length of respective combustors 30. Alternatively, the combustors 30 may be configured as single stage combustors, wherein fuel injectors are arranged for a single stage or zone of combustion. In the following discussion, the combustors 30 are described as single stage combustors, yet the disclosed embodiments may be utilized with either single stage or multi-stage combustors within the scope of the present techniques.

The disclosed embodiments of the combustor 30 include a variety of counterflow fuel-air injection mechanisms, which direct the air and fuel in one or more directions generally against the flow through the combustors 30. For example, the counterflow fuel-air injection mechanisms may include a plurality of lengthwise-directed fuel-air injectors, crosswise-directed fuel-air injectors, or angled fuel-air injectors having both lengthwise and crosswise directional portions. The lengthwise-directed fuel-air injectors may be generally aligned in lengthwise directions along the combustors 30, whereas the crosswise-directed fuel-air injectors may be generally aligned in crosswise, transverse, or radial directions relative to a lengthwise flow or axis along the combustors 30. The angled fuel-air injectors may be oriented in an acutely angled direction relative to a lengthwise flow axis or inner surface of the combustor 30. The acutely angled direction generally includes or can be broken down into lengthwise and crosswise directional portions. Each of these lengthwise directions, crosswise directions, and acutely angled directions may be defined as counterflow directions.

As discussed in further detail below, the counterflow fuel-air injection mechanisms inject the fuel and air away from the turbine 22 in these counterflow directions toward an opposite end of the combustor 30, such that the fuel and air mixes and combusts in a stagnation zone. The stagnation zone at the opposite end of the combustor 30 generally increases stability and anchoring of flames within the combustor 30. The hot products of combustion then travels back toward the turbine 22 past the counterflow fuel-air injection mechanisms. Again, the counterflow fuel-air injection mechanisms facilitate mixing of the fuel and air with the hot products of combustion. The hot products of combustion then pass through nozzles 32 leading to the turbine 22. These hot products of combustion drive the turbine 22, thereby driving the compressor 18 and a load 34 of the application 14 via the shaft 26. The hot products of combustion then exhaust through the exhaust section 24.

FIG. 2 is a lengthwise diagrammatical view of an exemplary embodiment of the combustor 30 as illustrated in FIG. 1, wherein the combustor 30 includes a counterflow injection mechanism 50 including a plurality of fuel-air injection lobes 52 disposed at different radial positions around the inner circumference of a combustion liner 54 in accordance with certain embodiments of the present technique. The illustrated combustion liner 54 includes a solid inner casing 56 surrounded by a perforated outer casing 58. In other words, the combustion liner 54 has a hollow wall structure, which has a generally continuous gap between the inner and outer casings 56 and 58. The combustion liner 54 may include a ceramic, a cermet, or another suitable material. The fuel-air injection lobes 52 are generally formed with, or coupled to, the solid inner casing 56. In the illustrated embodiment, the fuel-air injection lobes 52 are disposed at multiple radial positions around the solid inner casing 56 at one lengthwise position 60 relative to a central lengthwise axis 62 along the combustor 30. Accordingly, the illustrated combustor 30 is configured as a single stage combustor. However, other embodiments of the combustor 30 may have the fuel-air injection lobes 52 disposed at multiple lengthwise positions relative to the axis 62.

The illustrated counterflow injection mechanism 50 includes a fuel injection assembly 64 disposed adjacent an air injection assembly 66. In certain embodiments, the fuel and air injections assemblies 64 and 66 are arranged in close proximity to one another. The fuel injection assembly 64 includes a plurality of fuel injectors 68 having an elongated injector tip 70. The air injection assembly 66 includes a plurality of acutely angled air passages 72 disposed at various radial positions about the inner circumference of the solid inner casing 56. In certain embodiments, the elongated injector tip 70 may be disposed in close proximity to the air passage 72. For example, in the illustrated embodiment of FIG. 2, the elongated injector tip 70 is generally coaxial or concentric with the air passage 72. The elongated injector tips 70 and the air passages 72 both extend through a lobe structure 74 at multiple radial positions around the inner circumference of the solid inner casing 56. In other words, each of the fuel-air injection lobes 52 includes one of the elongated injector tips 70 and one of the air passages 72 disposed in one of the lobe structures 74. As illustrated, the lobe structures 74 include a protruding portion 76 and a recessed portion 78 on opposite lengthwise sides of the position 60. In certain embodiments, the lobe structures 74 each have a generally circular or annular configuration (e.g., a donut-like shape), wherein the geometry gradually changes between the protruding portion 76 and the recessed portion 78.

In the illustrated embodiment of FIG. 2, the elongated injector tips 70 and the air passages 72 of the respective fuel-air injection lobes 52 are oriented in a generally opposite or counterflow direction relative to the general flow 80 through the gas turbine engine 12 as discussed above with reference to FIG. 1. For example, the elongated injector tips 70 and the air passages 72 may be disposed at respective angles 82 and 84 relative to the axis 62 of the combustor 30. The angles 82 and 84 may be substantially the same or different than one another. The angles 82 and 84 also may vary between 0 and 90 degrees depending on the length of the combustion liner 54 and other factors. For example, the angles 82 and 84 may be about 5, 10, 15, 20, 25, 30, 35, 40, 45, 50, 55, 60, 65, 70, 75, 80, or 85 degrees relative to the axis 62 or the inner surface of the solid inner casing 56. Moreover, the elongated injector tips 70 and the air passages 72 of the fuel-air injection lobes 52 may be directed in a generally converging manner toward a stagnation zone 86 within a closed rear portion 88 of the solid inner casing 56. The stagnation zone 86 generally improves stability and anchoring of flames near the closed rear portion 88 of the combustor 30.

In operation, the combustor 30 as illustrated in FIG. 2 receives compressed air from the compressor 18 through openings 90 in the perforated outer casing 58 as indicated by arrows 92. Upon entering the combustion liner 54 through the perforated outer casing 58, the compressed air resides in an annular space between the solid inner casing 56 and the perforated outer casing 58. In other words, the combustion liner 54 has a hollow wall, e.g., a hollow annular or can-shaped wall, defined by the inner and outer casings 56 and 58. Advantageously, the combustion liner 54 directs the compressed air to flow along the solid inner casing 56 toward the plurality of fuel-air injection lobes 52 as indicated by arrows 94. In this manner, the air flow 94 facilitates cooling of the solid inner casing 56 prior to injection into the interior of the combustor 30 via the air passages 72.

At the fuel-air injection lobes 52, the elongated injector tips 70 inject fuel flows 96 that accompany air flows 98 from the air passages 72. In the illustrated embodiment, the fuel and air flows 96 and 98 are coaxial or concentric relative to one another. Specifically, the air flows 98 are disposed concentrically about the fuel flows 96 as a result of the concentric or coaxial configuration of the elongated injector tips 70 within the air passages 72. Again, the elongated injector tips 70 and air passages 72 are disposed at respective angles 82 and 84, thereby causing the fuel and air flows 96 and 98 to travel at least initially at the angles 82 and 84 in a converging manner toward the axis 62 and the stagnation zone 86. Thus, the coaxial or concentric configuration of the fuel-air injection lobes 52 and resultant flows 96 and 98 facilitate fuel-air mixing in the combustor 30 rather than premixing. In addition, the converging relationship of the fuel-air injection lobes 52 facilitates mixing of the fuel and air in the stagnation zone 86, as indicated by flow/mixing arrows 100. As illustrated, the flow 100 includes U-shaped flows inwardly toward the axis 62 and outwardly toward the walls of the solid inner casing 56. In other words, as the flows 100 move in the counterflow direction from the fuel-air injection lobes 52 toward the closed rear portion 88, the flows 100 generally reverse in a U-shaped manner both toward the axis 62 and the walls of the solid inner casing 56. A similar flow pattern occurs with the other embodiments discussed below. The fuel-air mixture 100 combusts in the stagnation zone 86 in the vicinity of the closed rear portion 88, which advantageously holds or anchors the flame to improve flame stability within the combustor 30.

Subsequently, the hot products of combustion travel from the stagnation zone 86 lengthwise along the combustor 30 toward the nozzle 32 as indicated by arrows 102. Thus, the hot products of combustion 102 flow in the same general direction 80 of flow through the gas turbine engine 12, whereas the fuel and air flows 96 and 98 injected from the fuel-air injection lobes 52 are generally counterflow. Again, the counterflow may be directed in a lengthwise direction toward the stagnation zone 86, or a crosswise direction relative to the axis 62 or solid inner casing 56, or an acutely angled direction having lengthwise and crosswise directional portions, or combinations thereof. In this manner, the counterflow injection mechanism 50 improves the mixture of fuel and air along with the hot products of combustion within the combustor 30, thereby improving the combustion and reducing pollutant emissions (e.g., NOx emissions) from the combustor 30. Also, the lobe structures 74 slightly offset the elongated injector tips 70 and the air passages 72 relative to the inner circumference of the solid inner casing 56, thereby positioning the injection of the fuel and air flows 96 and 98 slightly away from the inner circumference to improve the mixing of fuel, air, and hot products of combustion.

Figure 3:
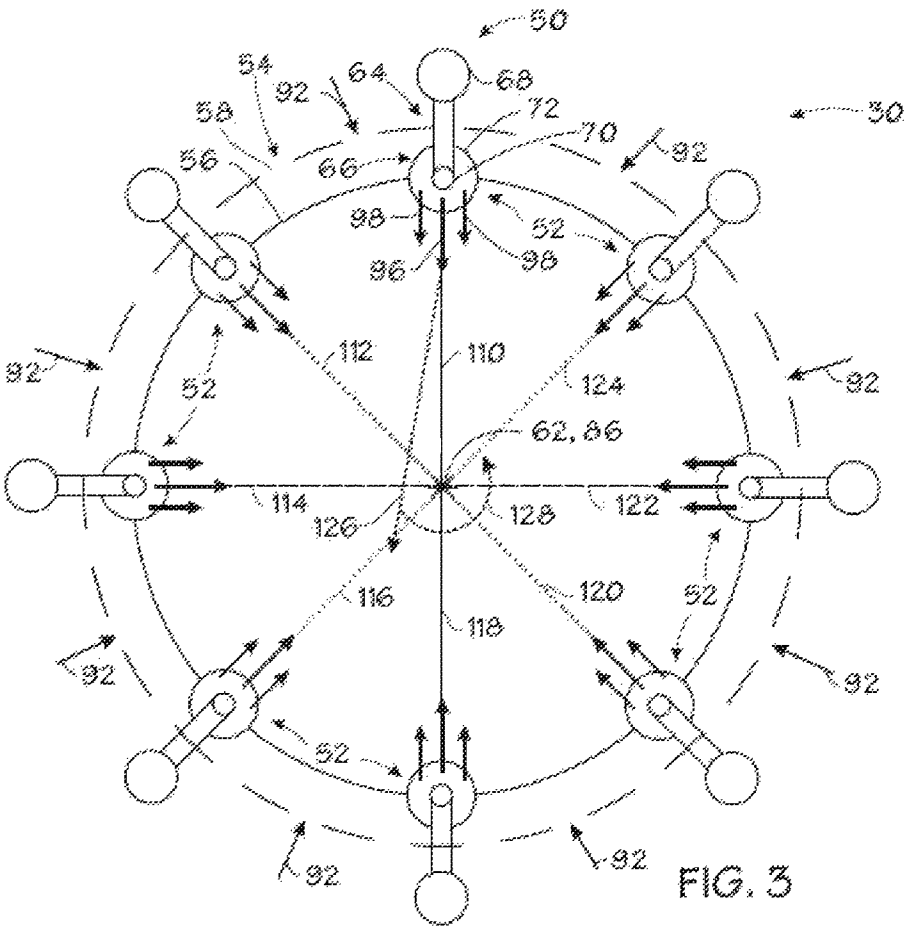
FIG. 3 is a crosswise diagrammatical view of an embodiment of the combustor as illustrated in FIG. 2, further illustrating the plurality of fuel-air injection lobes disposed at multiple radial positions along the circumference of the solid inner casing.

FIG. 3 is a crosswise diagrammatical view of the embodiment of the combustor 30 as illustrated in FIG. 2, further illustrating a radial configuration of the fuel-air injection lobes 52 of the counterflow injection mechanism 50 at multiple radial positions 110, 112, 114, 116, 118, 120, 122, and 124 about the solid inner casing 56 in accordance with certain embodiments of the present technique. As discussed above with reference to FIG. 2, the fuel and air flows 96 and 98 of the plurality of fuel-air injection lobes 52 generally converge toward the axis 62 within the stagnation zone 86. In certain embodiments, the fuel and air flows 96 and 98 may generally converge on center with the axis 62 as indicated by dashed lines 110, 112, 114, 116, 118, 120, 122, and 124.

In other embodiments, the fuel-air injection lobes 52 may be oriented toward the stagnation zone 86 in a converging manner toward the axis 62, while being at least slightly off-center relative to the axis 62 as indicated by dashed arrow 126. As a result of this off-center converging direction of the fuel-air injection lobe 52, the fuel and air flows 96 and 98 may create a swirling flow as indicated by dashed arrow 128. In either configuration, the converging relationship between the fuel-air injection lobes 52 facilitates fuel and air mixing within the stagnation zone 86 (and also mixing with the hot products of combustion). However, the addition of swirling flow 128 within the stagnation zone 86 may further improve the fuel-air mixing and combustion within the combustor 30. In some embodiments, the fuel-air injection lobes 52 all may be oriented to create a clockwise swirling flow or a counter clockwise swirling flow. Alternatively, the fuel-air injection lobes 52 may be staggered to produce both clockwise and counter clockwise swirling flows. For example, the odd fuel-air injection lobes 52 (e.g., at radial positions 110, 114, 118, and 122) may be oriented to produce a clockwise swirling flow, while the even fuel-air injection lobes 52 (e.g., at radial positions 112, 116, 120, and 124) may be configured to produce a counter clockwise swirling flow. Again, certain embodiments of the illustrated combustor 30 may include the annular array of fuel-air injection lobes 52 as illustrated in FIG. 3 at multiple lengthwise positions along the axis 62, such as in a multi-stage combustor 30 as mentioned above.

Figure 4:
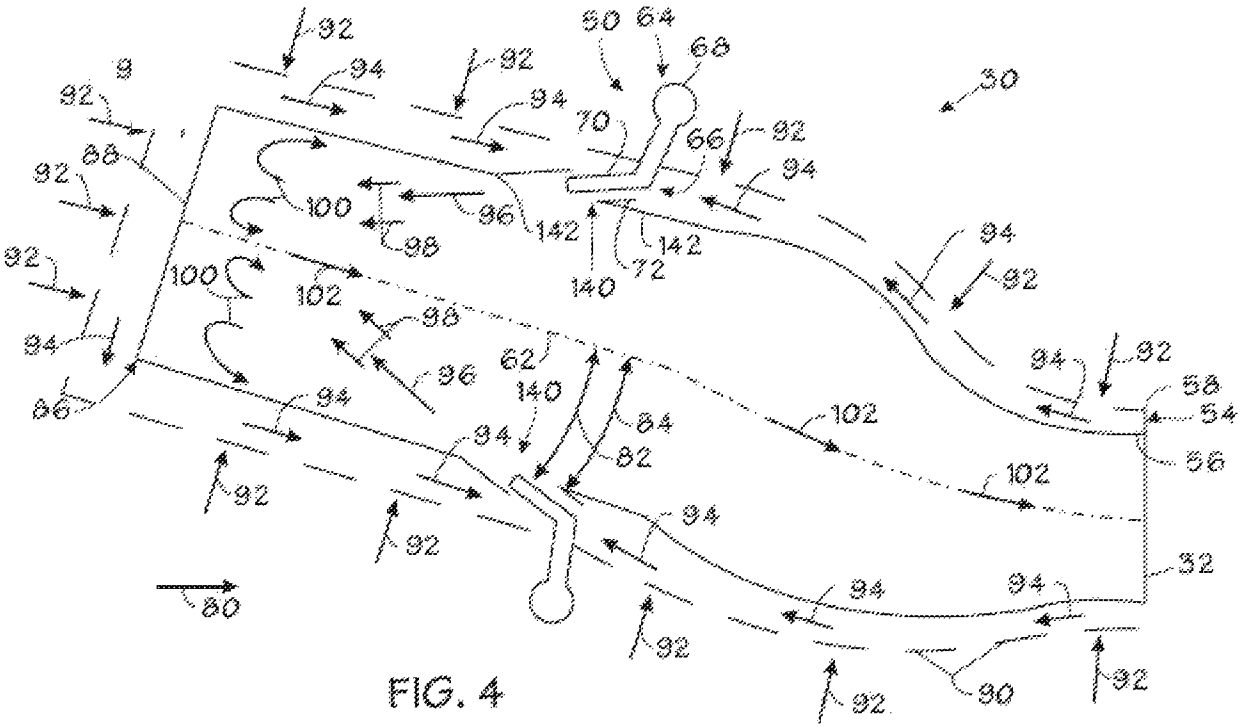
FIG. 4 is a lengthwise diagrammatical view of an alternative embodiment of the combustor as illustrated in FIGS. 1 and 2, further illustrating a counterflow injection mechanism having a radial array of flush fuel-air injection regions arranged circumferentially along a solid inner casing of the combustor.

FIG. 4 is a lengthwise diagrammatical view of an alternative embodiment of the combustor 30 as illustrated in FIGS. 1-3, wherein the counterflow injection mechanism 50 includes a radial array or arrangement of flush fuel-air injection regions 140 in accordance with certain embodiments of the present technique. As illustrated, the elongated injector tip 70 and the air passage 72 of the fuel and air injection assemblies 64 and 68 extend to positions that are substantially flush with the solid inner casing 56 of the combustion liner 54. In other words, the elongated injector tip 70 and the air passage 72 are generally recessed from the interior surface 142 of the solid inner casing 56, yet the inner casing 56 does not protrude in the vicinity of the elongated injector tip 70 and the air passage 72. Thus, in contrast to the fuel-air injection lobes 52 as illustrated in FIGS. 2 and 3, the radial array of flush fuel-air injection regions 140 as illustrated in FIG. 4 does not protrude into the interior of the combustor 30 beyond the solid inner casing 56. However, in certain embodiments, the elongated injector tips 70 may be oriented to partially protrude from the interior surface 142 of the solid inner casing 56. Alternatively, the elongated injector tips 70 may be retracted into the air passages 72 as illustrated and described in further detail below with reference to FIG. 12. Again, the counterflow injection mechanism 50 as illustrated in FIG. 4 is configured to direct the fuel and air flows 96 and 98 in a generally converging manner toward the stagnation zone 86 against the general flow 80 through the gas turbine engine 12. Subsequently, the hot products of combustion travel from the stagnation zone 86, past the radial array of flush fuel-air injection regions 140, and out of the combustor 30 through the nozzle 32.

FIG. 5 is a lengthwise diagrammatical view of another alternative embodiment of the combustor 30 as illustrated in FIG. 1, wherein the combustor 30 includes a counterflow injection mechanism 150 having a radial array of inwardly cantilevered fuel-air injection members 152 disposed along the interior of the solid inner casing 56 in accordance with certain embodiment of the present technique. In the illustrated embodiment, the fuel-air injection members 152 protrude inwardly from the solid inner casing 56 of the combustion liner 54 toward, but not reaching, the central lengthwise axis 62 of the combustor 30. In other words, the fuel-air injection members 152 are cantilevered and off-center from the axis 62.

The illustrated fuel-air injection members 152 have a co-flow body 154 with coaxial fuel-air ports 156 and 157 disposed along an edge 158 facing the stagnation zone 86. In the illustrated embodiment, the coaxial fuel-air ports 156 include three ports 156 that are generally parallel with the axis 62, while the coaxial fuel air port 157 includes a single port 157 that is angled inwardly toward (or converging upon) the axis 62 in the counterflow direction toward the stagnation zone 86. In alternative embodiments, the fuel-air ports 156 and 157 may include any other number or arrangement of ports disposed in a desired spacing along the co-flow body 156. The coaxial fuel-airports 156 are coupled to fuel pumps or injectors 160 and air passages 162 extending to the space between the solid inner casing 56 and the perforated outer casing 58 of the combustion liner 54.

Accordingly, the fuel-air injection members 152 receive both fuel and air through the co-flow body 154, which then injects co-flows of fuel and air from the coaxial fuel-air ports 156 and 157 into the combustor 30 in generally lengthwise directions toward the stagnation zone 86, as indicated by arrows 164 and 165. In the illustrated embodiment, the lengthwise flows 164 of fuel and air are generally parallel with the axis 62 of the combustor 40, while the flows 165 are generally converging toward the axis 62. However, in other embodiments, the coaxial fuel-air ports 156 may be oriented in a generally converging or diverging angle relative to the axis 62. Moreover, the coaxial fuel-air ports 156 and 157 may be directed in a generally clockwise or counter clockwise angle about the axis 62, such that swirling flow may be created within the combustor 30 as discussed above with reference to FIG. 3.

In operation, similar to the embodiment of FIG. 2, the combustor 30 receives compressed air through the perforated outer casing 58 and along the solid inner casing 56 toward the counterflow injection mechanism 150 as illustrated by arrows 92 and 94. Upon reaching the counterflow injection mechanism 150, the compressed air enters through the air passages 162 into the co-flow body 154 while fuel is received from the fuel pumps or injectors 160. The fuel-air injection members 152 then inject co-flows of both fuel and air from the ports 156 and 157 into the interior of the solid inner casing 56 as indicated by arrows 164 and 165. Again, these co-flows 164 and 165 are disposed at multiple peripheral-radial positions that are offset from the axis 62. In addition, the co-flows 164 and 165 are oriented toward the stagnation zone 86 in a generally opposite or counterflow direction relative to the general flow 80 through the gas turbine engine 12. In this manner, the fuel-air co-flows 164 and 165 facilitate fuel-air mixing, thereby improving combustion and reducing pollutant emissions in the combustor 40. In the stagnation zone 86, the fuel-air mixture 100 combusts, and the hot products of combustion then travel back past the counterflow injection mechanism 150 and onward to the nozzle 32 as indicated by arrows 102. Again, the fuel-air co-flows 164 and 165 are generally counterflow relative to the flow 102 of the hot products of combustion. Accordingly, this counterflow further improves the fuel-air mixing along with the hot products of combustion within the combustor 30, as discussed in detail above.

FIG. 6 is a crosswise diagrammatical view of the combustor 30 as illustrated in FIG. 5, further illustrating the radial array of inwardly cantilevered fuel-air injection members 152 of the counterflow injection mechanism 150 in accordance with certain embodiments of the present technique. The embodiment of FIG. 6 is slightly different than the embodiment of FIG. 5. Specifically, the number of ports 156 is four rather than three, and the length of the co-flow bodies 154 is relatively shorter than the embodiment of FIG. 5. However, the number of ports 156 and 157 may be increased or decreased as desired for the particular combustor 30. Moreover, the length of the bodies 154 may be increased to extend closer to the axis 62. Moreover, each of the ports 156 and 157 may be inwardly angled toward the axis 62.

In the illustrated embodiment, the fuel-air injection members 152 are disposed at multiple radial positions about the inner circumference or periphery of the solid inner casing 56, as indicated by dashed lines 166, 168, 170, 172, 174, 176, 178, and 180. In addition, the fuel-air injection members 152 are generally aligned or centered with the axis 62. However, an inner or free end of the inwardly cantilevered fuel-air injection members 152 is generally offset or off-center from the axis 62 as indicated by arrow 182. In certain embodiments, the fuel-air injection members 152 may be angled relative to the axis 62, thereby creating a counter clockwise or clockwise swirling flow downstream in the stagnation zone 86. For example, the fuel-air injection members 152 may be acutely angled relative to the inner surface of the solid inner casing 56 rather than being substantially perpendicular. In the illustrated embodiment, the counterflow injection mechanism 150 includes eight fuel-air injection members 152 in the peripheral-radial configuration as illustrated in FIGS. 5 and 6. However, other embodiments of the counterflow injection mechanism 150 may include another suitable number of fuel-air injection members 152.

FIG. 7 is a cross-sectional view of an exemplary embodiment of the fuel-air injection member 152 as illustrated in FIGS. 5 and 6, further illustrating co-flow passages within the interior of the co-flow body 154 in accordance with certain embodiments of the present technique. As illustrated, the co-flow body 154 has a generally aerodynamic geometry or airfoil structure. In addition, the co-flow body 154 includes a plurality of lateral fuel injection passages 184 extending from a lengthwise or common fuel supply passage 186 relative a lengthwise axis (e.g., perpendicular to the drawing) of the co-flow body 154. These passages 184 and 186 are generally supported by upper and lower support members 188 and 190 and one or more lateral support structures 192 having the passages 184. The co-flow body 154 also includes one or more air passages 194, 196, and 198. The illustrated fuel injection passages 184 and the air passages 194, 196, and 198 lead toward the coaxial fuel-air ports 156 and 157 along the edge 158 as discussed above. Specifically, as illustrated in FIG. 7, the coaxial fuel-air ports 156 and 157 include a central fuel port 200 from the lateral fuel injection passage 184 and a concentric or annular air port 202 from the air passages 194, 196, and 198. Accordingly, in operation, the fuel flows through the fuel-air injection member 152 as illustrated by arrows 204, while the air flows through the fuel-air injection member 152 as illustrated by arrows 206.

FIGS. 8-10 illustrate an alternative embodiment of the combustor 30 as illustrated in FIGS. 5-7, wherein the radial array of inwardly cantilevered fuel-air injection members 152 includes additional coaxial fuel-air ports 210 and 211 along top and bottom sides of the co-flow body 154 in accordance with certain embodiments of the present technique. Turning first to FIG. 8, this figure is a lengthwise diagrammatical view of the combustor 30, illustrating a series of the coaxial fuel-air ports 156 and 157 along the edge 158 and a series of the coaxial fuel-air ports 210 and 211 along a face of the co-flow body 154. As discussed above with reference to FIG. 5, the coaxial fuel-air ports 156 are generally oriented lengthwise relative to the axis 62 of the combustor 30, thereby producing coaxial flows of fuel and air as indicted by arrows 164. Again, these coaxial flows 164 may be generally aligned parallel with the axis 62, or converging relative to the axis 62, or diverging relative to the axis 62. However, these coaxial flows 164 are generally directed lengthwise along the combustor 30 toward the stagnation zone 86. Similarly, the coaxial fuel-air ports 157 (and the flows 165) are oriented along the length of the combustor 30 toward the stagnation zone 86. However, as discussed above, the coaxial fuel-air ports 157 (and the flows 165) generally converge toward the axis 62 in the counterflow direction toward the stagnation zone 86.

In contrast, the coaxial fuel-air ports 210 are directed crosswise at a distance relative to the axis 62. In other words, the coaxial fuel-air ports 210 are oriented to produce flows generally perpendicular to the view of FIG. 8. The coaxial fuel-air ports 211 are also directed crosswise relative to the axis 62. However, in contrast to the coaxial fuel-air ports 210, the coaxial fuel-air ports 211 are directed radially inward in a directly converging manner toward the axis 62, as indicated by arrows 167. In other words, the coaxial fuel-air ports 211 all point straight toward the axis 62 like spokes of a wheel or rays of the sun. In this manner, the fuel-air injection members 152 produce both lengthwise and crosswise flows to facilitate fuel and air mixing within the combustor 30.

FIG. 9 is a crosswise diagrammatical view of the combustor 30 as illustrated in FIG. 8, further illustrating crosswise flows 214 and 216 of fuel and air from the coaxial fuel-air ports 210 disposed on opposite faces 212 and 218 of the co-flow body 154 in accordance with certain embodiments of the present technique. Again, the embodiment of FIG. 9 is slightly different than the embodiment of FIG. 8. Specifically, the number of ports 156 and 210 is four rather than three, and the length of the co-flow bodies 154 is relatively shorter than the embodiment of FIG. 8. However, the number of ports 156, 157, 210, and 211 may be increased or decreased as desired for the particular combustor 30. Moreover, the length of the bodies 154 may be increased to extend closer to the axis 62. Moreover, each of the ports 156, 157, 210, and 211 may be inwardly angled toward the axis 62.

As illustrated in FIG. 9, the coaxial flows 214 and 216 are generally offset from the axis 62 by progressively greater distances from the free end of the co-flow body 154 to the solid inner casing 56 of the combustor liner 54. In addition, the co-flows 214 are generally oriented in a clockwise orientation about the axis 62, whereas the co-flows 216 are oriented in a generally counter clockwise direction around the axis 62. In this manner, the co-flows 214 and 216 may produce counter rotating or swirling flows as indicated by arrows 220 and 222, respectively. In addition, the coaxial flows 165 and 167 are generally converging toward the axis 62, such that the coaxial flows 165 and 167 are generally transverse or crosswise relative to the coaxial flows 214 and 216.

FIG. 10 is a cross-sectional view of the fuel-air injection member 152 as illustrated in FIGS. 8 and 9, further illustrating internal passages leading to the coaxial fuel-air ports 210 and 211 disposed on the faces 212 and 218 in accordance with certain embodiments of the present technique. Again, similar to the embodiment of FIG. 7, the co-flow body 154 has a generally aerodynamic geometry or airfoil structure, and a plurality of lateral fuel injection passages 184 extending from a first one of the lengthwise or common fuel supply passage 186 relative a lengthwise axis (e.g., perpendicular to the drawing) of the co-flow body 154. The co-flow body 154 also includes one or more air passages 194, 196, and 198. The illustrated fuel injection passages 184 and the air passages 194, 196, and 198 lead toward the coaxial fuel-air ports 156 and 157 along the edge 158 as discussed above. Specifically, as illustrated in FIG. 7, the coaxial fuel-air ports 156 and 157 include a central fuel port 200 from the lateral fuel injection passage 184 and a concentric or annular air port 202 from the air passages 194, 196, and 198.

In addition to the features of the embodiment of FIG. 7, the upper and lower support members 188 and 190 of FIG. 10 include upper and lower fuel injection passages 230 and 232 leading from a second one of the lengthwise or common fuel supply passage 186 to fuel injection ports 234 and 236 on the opposite faces 212 and 218, respectively. In other words, the illustrated embodiment includes two independent fuel supply passages 186, such that the ports 156 and 157 are supplied fuel independently from the ports 210 and 211. In alternative embodiments, a single fuel supply passage 186 may be used for all of the ports 156, 157, 210, and 211. In further alternative embodiments, an independent fuel supply passage 186 may be used for each set of ports 156, 157, 210, and 211. The coaxial fuel-air ports 210 and 211 also include air injection ports 238 and 240 disposed concentrically or annularly about the fuel injection ports 234 and 236, respectively. Accordingly, in operation, fuel and air flows through the fuel-air injection member 152 as indicated by arrows 204 and 206.

FIG. 11 is lengthwise diagrammatical view of another embodiment of the combustor 30 as illustrated in FIG. 5, wherein the counterflow injection mechanism 150 has a single inwardly cantilevered fuel-air injection member 152 disposed at, or in close proximity to, or inside the nozzle 32 in accordance with certain embodiments of the present technique. As illustrated, the co-flow body 154 of the single cantilevered fuel-air injection mechanism 152 protrudes from one side of the solid inner casing 56, and extends across a substantial portion of the diameter at the nozzle 32. Accordingly, in this embodiment, the co-flow body 154 extends across the central lengthwise axis 62 of the combustor 30 at the nozzle 32. The coaxial fuel-air ports 156 are arranged across both sides of the axis 62, such that the fuel-air injection member 152 provides the coaxial flows 164 of fuel and air at off-center or offset positions relative to the axis 62. In the illustrated embodiment, one of the coaxial fuel-air ports 156 is generally aligned or centered along the axis 62, thereby providing one coaxial flow 164 of fuel and air that is centered on the axis 62. In some embodiments, the fuel-air injection member 152 may further include coaxial fuel-air ports 210, such as those illustrated in the embodiment of FIGS. 8-10. Moreover, it should be noted that the combustor 30 may have a relatively shorter length as compared to the embodiments of FIGS. 2, 4, 5, and 8, because the counterflow injection mechanism 150 is disposed at or near the nozzle 32 rather than at an intermediate position between the closed end 88 and the nozzle 32 of the combustor 30.

FIGS. 12-15 are diagrammatical views illustrating various alternative embodiments for fuel-air injection mechanisms, such as the fuel-air injection lobes 52, the flush fuel-air injection regions 140, and the inwardly cantilevered fuel-air injection members 152, as discussed in detail above with reference to FIGS. 2-11. Turning first to the embodiment of FIG. 12, this figure illustrates a coaxial fuel-air injection mechanism 260 in accordance with certain embodiments of the present technique. As illustrated, the coaxial fuel-air injection mechanism 260 includes a central fuel passage 262 along an axis 264 and a concentric or outer annular air passage 266 disposed concentrically about the central fuel passage 262. In the illustrated embodiment, an end 268 of the central fuel passage 262 is disposed at an offset distance 270 relative to an end 272 of the concentric or outer annular air passage 266. Specifically, the end 268 of the central fuel passage 262 is recessed relative to the end 272 of the concentric or outer annular air passage 266. However, in other embodiments of the coaxial fuel-air injection mechanism 260, the ends 268 and 272 may be substantially flush with one another or the end 268 of the central fuel passage 262 may protrude outwardly from the end 272 of the concentric or outer annular air passage 266. In operation, the coaxial fuel-air injection mechanism 260 produces a central fuel flow 274 surrounded by an annular air flow 276, which facilitates fuel-air mixing within the combustor 30.

FIG. 13 is a diagrammatical view of an exemplary radial-axial fuel-air injection mechanism 280 having both radial and axial flows that collide with one another to facilitate fuel-air mixing in accordance with certain embodiments of the present technique. In the illustrated embodiment, the radial-axial fuel-air injection mechanism 280 includes a central fuel passage 282 along an axis 284 and a concentric or outer annular air passage 286 disposed about the central fuel passage 282. In addition, the central fuel passage 282 includes one or more radial ports 288 that are generally perpendicular relative to the axis 284. The central fuel passage 282 also has a tapered section or end 290 downstream from the radial ports 288. In operation, air travels through the concentric or outer annular air passage 286 about the central fuel passage 282 in an axial direction along the axis 284 as indicated by arrows 292. In addition, fuel flows through the central fuel passage 282 in a generally axial direction along the axis 284 as indicated by arrow 294. Upon reaching the radial ports 288, the fuel travels radially outward from the axis 284 into the air flow 292, as indicated by arrows 296. Thus, the air and fuel flows 292 and 296 are generally crosswise or perpendicular to one another to facilitate fuel and air mixing within the radial-axial fuel-air injection mechanism 280 just prior to injection into the combustor 30. In addition, the radial-axial fuel-air injection mechanism 280 facilitates fuel-air mixing within the combustor 30 rather than premixing the fuel and air.

FIG. 14 is a diagrammatical view of an alternative radial-axial fuel-air injection mechanism 300 in accordance with certain embodiments of the present technique. As illustrated, a fuel injection mechanism 302 is coupled to an outer wall 304 of a central air passage 306. The illustrated fuel injection mechanism 302 includes a plurality of radial fuel ports 308 extending through the outer wall 304. In operation, air flows through the central air passage 306 in a generally axially direction 310 along an axis 312. In contrast, fuel flows through the radial fuel ports 308 in a generally radial or crosswise direction 314 relative to the axis 312. In this manner, the air and fuel flows 310 and 314 collide with one another within the radial-axial fuel-air injection mechanism 300. The collision of air and fuel flows 310 and 314 facilitates fuel-air mixing within the injection mechanism 300. In addition, the radial-axial fuel-air injection mechanism 300 facilitates fuel-air mixing within the combustor 30 rather than premixing the fuel and air.

FIG. 15 is a diagrammatical view of an alternative coaxial fuel-air swirling injection mechanism 320 in accordance with certain embodiments of the present technique. As illustrated, the swirling injection mechanism 320 includes a central fuel passage 322 extending along an axis 324 and a concentric or outer annular air passage 326 disposed about the central fuel passage 322. In addition, the central fuel passage 322 includes a fuel swirling mechanism 328 disposed at or near a fuel exit or port 330. The concentric or outer annular air passage 326 also includes one or more air swirling mechanisms 332 disposed upstream from the fuel exit or port 330. In operation, fuel travels through the central passage 322 in a generally axial direction 334 along the axis 324. Upon reaching the fuel swirling mechanism 328, the fuel flow gains a clockwise or counterclockwise rotation or swirl as indicated by arrow 336. Similarly, the air flows through the concentric or outer annular air passage 326 in a generally axial direction as indicated by arrows 338. Upon reaching the air swirling mechanism 332, the air flow gains rotation in a clockwise or counter clockwise direction as indicated by arrow 340. In this manner, the rotating or swirling fuel and air flows 336 and 340 facilitate fuel and air mixing within the swirling injection mechanism 320.

In certain embodiments, the rotating or swirling fuel and air flows 336 and 340 have a common rotational direction, such as either clockwise or counter clockwise. However, in other embodiments, the rotational or swirling fuel and air flows 336 and 340 may have opposite rotational directions, such as clockwise and counter clockwise, or vice versa. Moreover, some embodiments of the swirling injection mechanism 320 may include only the air swirling mechanism 332 without the fuel swirling mechanism 328, or only the fuel swirling mechanism 328 without the air swirling mechanism 332. Other embodiments may include additional fuel or air swirling mechanisms 328 and 332 disposed in series or in parallel with one another. Again, these swirling mechanisms 328 and 332 facilitates fuel and air mixing within the swirling injection mechanism 320. In addition, the coaxial fuel-air swirling injection mechanism 320 facilitates fuel-air mixing within the combustor 30 rather than premixing the fuel and air.

While the invention may be susceptible to various modifications and alternative forms, specific embodiments have been shown by way of example in the drawings and have been described in detail herein. However, it should be understood that the invention is not intended to be limited to the particular forms disclosed. Rather, the invention is to cover all modifications, equivalents, and alternatives falling within the spirit and scope of the invention as defined by the following appended claims.

The invention claimed is:

1. A method, comprising:

injecting fuel and air from an injection mechanism disposed in a combustion liner of an axial gas turbine combustor, the combustion liner disposed within a combustor housing and including an outer casing comprising a plurality of openings formed along a length and configured as compressed air inlets, an inner casing having a closed rear end and a combustion outlet and an air circulation path extending between and along the inner and outer casings, the injection mechanism including at least one fuel injector extending through the air circulation path, the at least one fuel injector having a fuel passage leading to a fuel injection opening and an air injection assembly leading to an air passage and an air injection opening, wherein the fuel injection opening and the air injection opening are disposed at an off-center position to provide injecting of the fuel and air toward the closed rear end of the inner casing in a direction counterflow to a generally lengthwise downstream flow of combustion products in the axial gas turbine combustor.

2. The method of claim 1, wherein injecting fuel and air comprises injecting fuel and air from a plurality of flush injection regions disposed at multiple radial positions about an inner circumference of the gas turbine combustor, wherein the plurality of flush injection regions are configured flush with the inner casing of the as turbine combustor so as to not protrude into an interior of the gas turbine combustor.

3. The method of claim 1, wherein injecting fuel and air comprises injecting fuel and air from a plurality of fuel-air injection lobes disposed at multiple radial positions about an inner circumference of the gas turbine combustor.

4. The method of claim 1, wherein injecting fuel and air comprises injecting fuel and air from a plurality of cantilevered aerodynamic members disposed at multiple radial positions about an inner circumference of the gas turbine combustor.

5. The method of claim 1, wherein injecting fuel and air comprises injecting fuel and air from a plurality of fuel-air injectors oriented to converge toward a stagnation zone in the gas turbine combustor.

6. The method of claim 1, wherein injecting fuel and air comprises circulating air through a hollow annular combustion liner and injecting the air into the gas turbine combustor along with fuel.

7. The method of claim 1, wherein injecting fuel and air comprises injecting from a position within a turbine nozzle.

8. The method of claim 1, wherein injecting fuel and air comprises injecting fuel and air from a plurality of fuel-air injection disposed in a circumferential arrangement.

9. The method of claim 1, wherein injecting fuel and air comprises injecting fuel and air from a plurality of fuel-air injection mechanisms oriented in a generally converging relationship.

10. The method of claim 1, wherein injecting fuel and air comprises injecting fuel and air from a plurality of fuel-air injection mechanisms including a plurality of coaxial fuel-air openings oriented in counterflow directions, including substantially lengthwise directional portions, relative to the generally lengthwise flow axis of the axial gas turbine combustor.

11. The method of claim 1, wherein injecting fuel and air comprises injecting fuel and air from a plurality of fuel-air injection mechanisms disposed in a plurality of lobe structures, flush wall portions, cantilevered members, or airfoil structures.

12. A method, comprising:

injecting fuel and air at an off-center position and in a direction counterflow to a generally lengthwise downstream flow of combustion products in a gas turbine combustor, wherein injecting fuel and air comprises injecting fuel and air from at least one fuel-air injection mechanism disposed in a combustion liner of an axial gas turbine combustor, the combustion liner disposed within a combustor housing and including an outer casing comprising a plurality of openings formed along a length and configured as compressed air inlets, an inner casing having a closed rear end and a combustion outlet, and an air circulation path extending between and along the inner and outer casings, the at least one fuel-air mechanism extending through the air circulation path, the at least one fuel-air injection mechanism having a fuel passage leading to fuel injection opening and an air injection assembly leading to an air passage and an air injection opening, wherein the fuel and air injection openings are disposed at an off-center position position to inject fuel and air toward the closed rear end of the gas turbine combustor.

13. The method of claim 12, wherein injecting fuel and air comprises injecting fuel and air from a plurality of flush injection regions disposed at multiple radial positions about an inner circumference of the gas turbine combustor, wherein the plurality of flush injection regions are configured flush with a solid inner casing of the as turbine engine so as to not protrude into an interior of the gas turbine combustor.

14. The method of claim 12, wherein injecting fuel and air comprises injecting fuel and air from a plurality of fuel-air injection lobes disposed at multiple radial positions about an inner circumference of the gas turbine combustor.

15. The method of claim 12, wherein injecting fuel and air comprises injecting fuel and air from a plurality of cantilevered aerodynamic members disposed at multiple radial positions about an inner circumference of the gas turbine combustor.

16. The method of claim 12, wherein injecting fuel and air comprises injecting fuel and air from a plurality of fuel-air injectors oriented to converge toward a stagnation zone in the gas turbine combustor.

17. A method, comprising: injecting fuel and air at an off-center position and in a counterflow direction relative to a generally lengthwise downstream flow combustion products in an a gas turbine combustor, wherein injecting fuel and air comprises injecting fuel and air from at least one fuel-air injection mechanism disposed within a combustion liner, the combustor liner disposed within a combustor housing, an air circulation path extending between and along an inner casing and an outer casing of the combustor liner and having a generally lengthwise flow axis extending from a stagnation zone at a closed rear end of the gas turbine combustor to a combustion outlet of the gas turbine combustor, the at least one fuel-air injection mechanism having a fuel passage leading to fuel injection opening and an air injection assembly leading to an air passage and an air injection opening, the outer casing comprising a plurality of openings formed along a length and configured as compressed air inlets, wherein the fuel and air injection openings are disposed at an off-center position to inject fuel and air toward a the closed rear end of the gas turbine combustor and in a direction generally counterflow to a generally lengthwise downstream flow of combustion products in the gas turbine combustor.

18. The method of claim 17, wherein injecting fuel and air comprises injecting fuel and air from a plurality of fuel-air injection mechanisms disposed in a plurality of lobe structures, flush wall portions, Of cantilevered members, or airfoil structures.

19. The method of claim 17, wherein injecting fuel and air comprises injecting fuel and air from a plurality of fuel-air injection mechanisms oriented in a generally converging relationship.

20. The method of claim 17, wherein injecting fuel and air comprises injecting fuel and air from a plurality of fuel-air injection mechanisms including a plurality of coaxial fuel-air openings oriented in counterflow directions, including substantially lengthwise directional portions, relative to the generally lengthwise flow axis of the axial gas turbine combustor.

* * * * *

UNITED STATES PATENT AND TRADEMARK OFFICE

CERTIFICATE OF CORRECTION

PATENT NO. : 8,789,375 B2
APPLICATION NO. : 13/653258
DATED : July 29, 2014
INVENTOR(S) : Haynes It is certified that error appears in the above-identified patent and that said Letters Patent is hereby corrected as shown below:

In the Specification

In Column 8, Line 32, delete "co-flow body 156." and insert -- co-flow body 154. --, therefor.

In the Claims

In Column 14, Line 15, in Claim 2, delete "as turbine" and insert -- gas turbine --, therefor.

In Column 15, Line 7, in Claim 12, delete "position position to" and insert -- position to --, therefor.

In Column 15, Line 15, in Claim 13, delete "as turbine" and insert -- gas turbine --, therefor.

In Column 16, Line 15, in Claim 17, delete "toward a the" and insert -- toward a --, therefor.

In Column 16, Line 23, in Claim 18, delete "Of cantilevered" and insert -- cantilevered --, therefor.

Signed and Sealed this
Twenty-fifth Day of November, 2014

Michelle K. Lee

Michelle K. Lee
*Deputy Director of the United States Patent and Trademark Office*